US006279643B1

(12) United States Patent
Shipman

(10) Patent No.: US 6,279,643 B1
(45) Date of Patent: Aug. 28, 2001

(54) PREFABRICATED FURNITURE

(75) Inventor: David A. Shipman, Grand Rapids, MI (US)

(73) Assignee: Steelcase Inc., Grand Rapids, MI (US)

( * ) Notice: Subject to any disclaimer, the term of this patent is extended or adjusted under 35 U.S.C. 154(b) by 0 days.

(21) Appl. No.: 09/325,335

(22) Filed: Jun. 3, 1999

(51) Int. Cl.[7] ..... A47G 5/00; A47F 10/00

(52) U.S. Cl. ..... 160/351; 52/64; 52/220.7; 52/220.2; 52/239; 52/769

(58) Field of Search ..... 52/64, 126.3, 220.2, 52/220.7, 238.1, 239, 243.1, 764, 769, 240; 160/330, 350, 351

(56) References Cited

U.S. PATENT DOCUMENTS

| | | | |
|---|---|---|---|
| 3,453,789 | * | 7/1969 | Stephenson . |
| 5,159,793 | * | 11/1992 | Deugo et al. . |
| 5,511,348 | * | 4/1996 | Corenll et al. . |
| 5,524,402 | * | 6/1996 | Sykes . |
| 5,675,949 | * | 10/1997 | Forslund et al. . |
| 5,697,193 | | 12/1997 | Forslund, III et al. . |
| 5,724,778 | * | 3/1998 | Cornell et al. . |
| 5,768,840 | | 6/1998 | Feldpausch et al. . |
| 5,784,843 | | 7/1998 | Greer et al. . |
| 5,809,708 | * | 8/1998 | Greer et al. . |
| 5,899,025 | * | 4/1999 | Casey et al. . |
| 5,950,371 | * | 9/1999 | Rives et al. . |
| 5,974,742 | * | 11/1999 | Schreiner et al. . |
| 6,003,275 | * | 12/1999 | Cornell et al. . |
| 6,112,472 | * | 9/2000 | Van Dyke et al. . |

FOREIGN PATENT DOCUMENTS

2676775 * 11/1992 (FR) ..... 52/239

OTHER PUBLICATIONS

"Ponté" by Steelcase Strafor (18 pages) dated prior to Jun. 3, 1998.

"Inhaus Q10" by Holzäpfel/Bolte (1 pg.) dated prior to Oct. 1998.

"Work In Progress (W.I.P.) Ito Design" by König+Neurath (7 pgs.) dated prior to Oct. 1998.

"Space In Progress" by Bosse (2 pgs.) dated prior to Oct. 1998.

"Raum 21" by Gumpo Büro Möbel (2 pgs.) dated prior to Oct. 1998.

Unknown Title by Estel (3 pgs.) dated prior to Oct. 1998.

* cited by examiner

*Primary Examiner*—Robert Canfield
(74) *Attorney, Agent, or Firm*—Price, Heneveld, Cooper, DeWitt & Litton

(57) ABSTRACT

A prefabricated furniture system including an overhead framework having utility conduits and supporting a plurality of rigid infill panels. The framework extends over a floor of a building space, and has a plurality of posts, and a plurality of beams, at least some of which are supported at a predetermined elevation above an average user height to define an open, three-dimensional gridwork which spatially partitions the associated portion of the building space. The utility conduits extend along the posts and the beams to provide access to utilities throughout the gridwork. The rigid infill panels are constructed to permit bodily translation of the same by an adult user, and are shaped for positioning between the beams and the floor of the building in side-by-side juxtaposition. Each of the infill panels have upper and lower panel portions equipped to removably retain the same in a selected positioned within the gridwork, wherein the upper panel portion is adapted to engage a lower surface of an adjacent beam, and the lower panel portion is adapted to engage the floor. At least one of the upper and lower panel portions includes a resiliently extensible retainer that biases outwardly to create tight engagement between the infill panels and the floor and associated beams for securely, yet removably, retaining the same in place.

27 Claims, 8 Drawing Sheets

PREFABRICATED FURNITURE

CROSS-REFERENCES TO RELATED APPLICATIONS

The present application is related to commonly assigned, co-pending U.S. patent application Ser. No. 09/325,482, filed on even date herewith, entitled PREFABRICATED FURNITURE SYSTEM.

BACKGROUND OF THE INVENTION

The present invention relates to furniture systems for subdividing building space, and more particularly to an integrated furniture system that includes an open framework and a plurality of rigid infill panels supported by the framework for subdividing and outfitting the building space.

Partition systems are well-known in the art for subdividing building space into physically separated work and/or office areas. The partition systems are typically constructed to support individual office-type work activities, and are often adapted for specialized functions, such as carrying utilities, supporting furniture and accessories, providing visual comfort and aesthetics, sound absorption, and the like. Physical separation, privacy, and aesthetics are typically very important to such systems.

Overhead framework systems that are adapted to support activities in open areas, such as for meeting areas and common areas, are also known. Many of these systems include an overhead framework of beams that are supported by posts. The openness of these systems is particularly conducive to group activities, where conversation and interaction is very important.

Partition systems are also known for subdividing a building space into individual office areas. Some of these partitions are constructed to be rearrangable. However, rearranging the partition panels within the existing framework has proven to be problematic typically requiring extensive knowledge of the construction of the system as well as extensive disassembly and reassembly of the system each time the user desires to reconfigure the partition system. Typically, rearranging the panels within the framework cannot be accomplished by the user and requires technical assistance from personnel of the manufacturing or distribution company. This shortcoming is exacerbated in situations in which the configuration requirements quickly change. Further, the interface and interconnection of the panels supported by the framework and the floor can be problematic, since the framework may be uneven due to a non-level floor. In addition, many of these systems do not provide the user with the ability to incorporate mid-height panels that do not extend the entire height of the framework. If provided, these partial height panels are typically difficult to adjust, manipulate, and rearrange similar to as described above.

Accordingly, an integrated furniture system is desired solving the aforementioned problems, and yet which maintains the advantages of systems adapted for separate use and for rearrangement.

SUMMARY OF THE INVENTION

One aspect of the present invention is to provide a prefabricated furniture system for interior building space and the like of the type having a floor with an open plan, which includes an overhead framework having utility conduits and that are adapted for supporting a plurality of rigid infill panels. The overhead framework extends over the floor of the building space, and includes a plurality of posts, and a plurality of beams, at least some of which are supported at a predetermined elevation above an average user height to define an open, three-dimensional gridwork that spatially partitions the associated portion of the building space. The utility conduits extend along the posts and the beams to provide access to utilities throughout the gridwork. The rigid infill panels are each constructed to permit easy, manual, bodily translation of the same by an adult user, and are shaped for positioning between the beams and the floor of the building in side-by-side juxtaposition. Each of the infill panels has upper and lower panel portions equipped to retain the same in a selected position within the gridwork. The upper panel portion is adapted to engage a lower surface of an adjacent beam. The lower panel portion is adapted to engage the floor. At least one of the upper and lower panel portions includes a resiliently extensible retainer which biases outwardly to create tight engagement between the infill panels and the floor and the associate beams for securely, yet removably, retaining the same in place. The infill panels can be quickly and easily installed by the user at various locations throughout the gridwork to create workstations with visual privacy and utility access, and can be rearranged by the user to accommodate different work requirements.

Another aspect of the present invention is to provide a prefabricated furniture system for interior building space and the like of the type having a floor with an open plan, and that includes a framework having utility conduits and adapted for supporting a plurality of rigid infill panels. The framework extends over the floor of the building space, and includes a plurality of posts, and a plurality of beams supported at a predetermined elevation to define an open, three-dimensional gridwork, which spatially partitions the associated portion of the building space. The utility conduits extend along the posts and the beams to provide access to the utilities throughout the gridwork. The plurality of rigid infill panels are each constructed to permit easy, manual, bodily translation of the same by an adult user, and are shaped for positioning between the beams. Each of the infill panels has upper and lower panel portions equipped to removably retain the same in a selected position within the gridwork. The upper panel portion is adapted to engage a lower surface of an adjacent one of the beams. The lower panel portion is adapted to engage an upper surface of an adjacent one of the beams. At least one of the upper and lower panel portions includes a resiliently extensible retainer which biases outwardly to create a tight engagement between the infill panels and the associated beams for securely, yet removably, retaining the same in place. The infill panels can be quickly and easily installed by the user at various locations throughout the gridwork to create workstations with visual privacy and utility access, and can be rearranged by the user to accommodate different work requirements.

Yet another aspect of the present invention is a method for partitioning interior building space and the like having a floor with a open plan, that includes erecting an overhead framework over the floor of the building space, by assembling a plurality of posts, and a plurality of beams, at least some of which are supported at a predetermined elevation above average user height to define an open, three-dimensional gridwork which spatially partitions the associated portion of the building space, and providing utility conduits along the posts and the beams to provide access to the utilities throughout the gridwork. The method further includes providing a plurality of rigid infill panels that are constructed to permit easy, manual, bodily translation of the same by an adult user, are shaped for positioning between the beams and the floor of the building, and have upper and lower panel portions equipped to removably retain the same in a selected position within the gridwork, wherein the upper panel portion is adapted to engage a lower surface of the adjacent one of the beams, the lower panel portion is adapted to engage the floor, and at least one of the upper and lower panel portions includes a resiliently extensible retainer which biases outwardly to create tight engagement between the infill panels and the floor and associated beams. The method still further includes manually installing the infill panels between the floor and the beams in side-by-side juxtaposition by selectively compressing the retainer and then releasing the same once the infill panel is in place under the beam, thereby securely, yet removably, retaining the same in place, whereby the infill panels are quickly and easily installed by the user at various locations throughout the gridwork to create workstations with visual privacy and utility access, and can be rearranged by the user to accommodate different work requirements.

The present inventive furniture system is easily rearrangable without requiring extensive knowledge of the construction of the system. In addition, rearrangement and reconfiguration of the system can be done quickly, thereby lending itself to be used in environments having rapidly changing requirements. The system also lends itself towards use in buildings/rooms having uneven floors.

These and other aspects, objects, and advantages of the present invention will be understood and appreciated by those skilled in the art by reference to the present specification, claims, and appended drawings.

DETAILED DESCRIPTION OF PREFERRED EMBODIMENT

Figure 1:
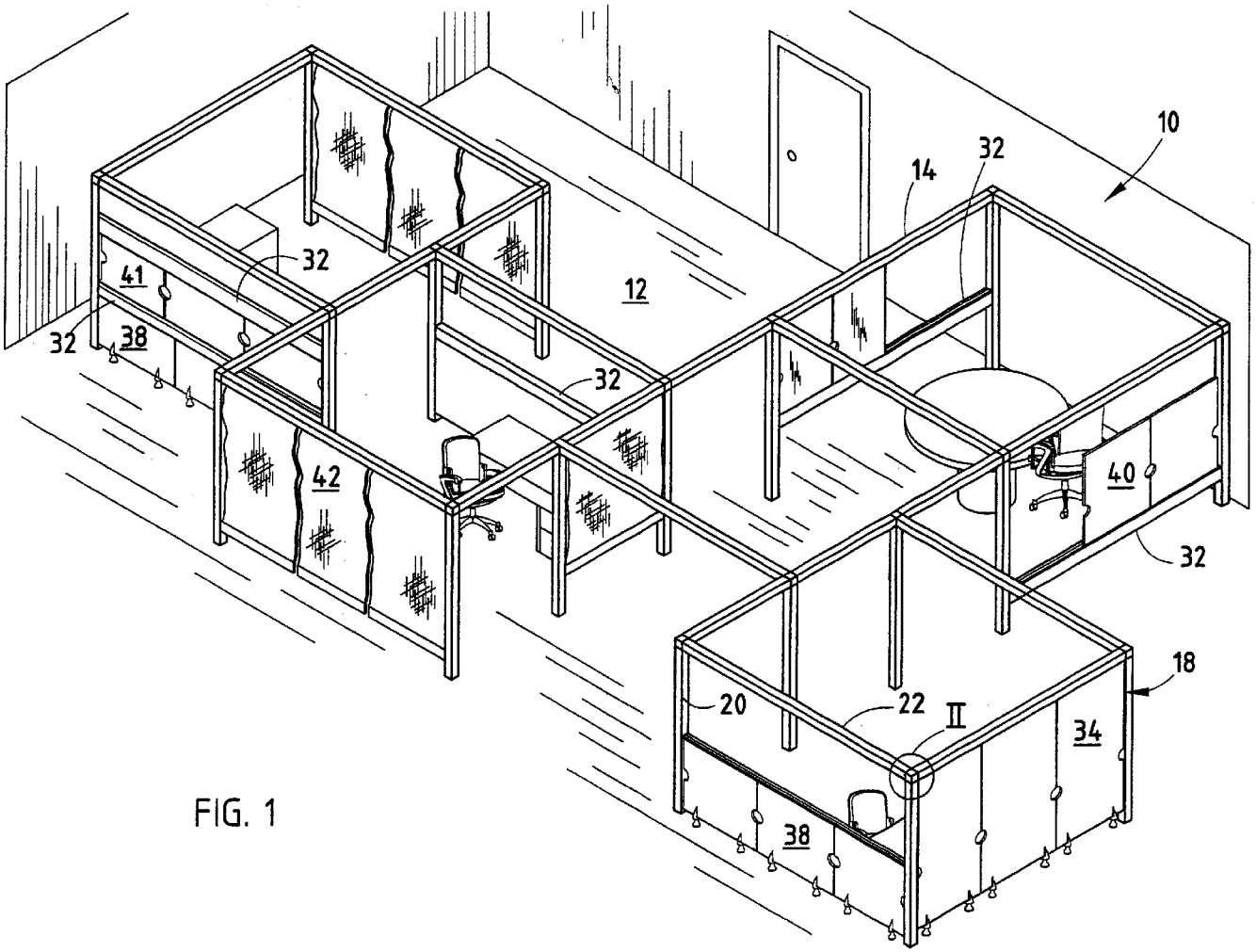
FIG. 1 is a perspective view of prefabricated furniture system embodying the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
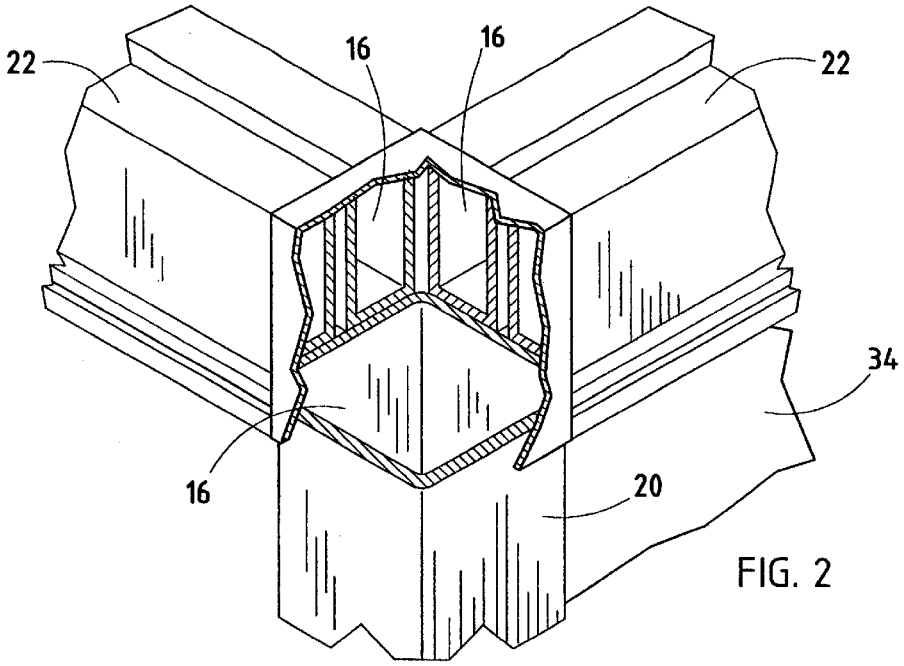
FIG. 2 is a fragmentary perspective view of a three-dimensional frame of the furniture system.

The reference numeral 10 (FIG. 1) generally designates a prefabricated furniture system for interior building space and the like of the type having a floor 12 with an open plan. Furniture system 10 includes an overhead framework 14 having utility conduits 16 (FIG. 2) and that is adapted for supporting a plurality of rigid infill panels 18. The overhead framework 14 extends over the floor 12 of the building space, and includes a plurality of posts 20, and a plurality of beams 22, at least some of which are supported at a predetermined elevation above an average user height to define an open, three-dimensional gridwork that spatially partitions the associated portion of the building space. The utility conduits (FIG. 2) extend along posts 20 and beams 22 to provide access to utilities throughout the gridwork. The rigid infill panels 18 are each constructed to permit easy, manual, bodily translation of the same by an adult user, and are shaped for positioning between beams 22 and floor 12 of the building in side-by-side juxtaposition. Each of the infill panels 18 has an upper panel portion 24 and a lower panel portion 26 that is equipped to retain the same in a selected position within the framework 14. Upper panel portion 24 (FIG. 3) is adapted to engage a lower surface 28 of an adjacent beam 22. Lower panel portion 26 is adapted to engage floor 12. At least one of upper panel portion 14 and lower panel portion 26 includes a resiliently extensible retainer 30 that biases outwardly to create tight engagement between infill panel 18 and floor 12 and/or the associate beams 22 for securely, yet removablely, retaining the same in place. Infill panels 18 can be quickly and easily installed by the user at various locations throughout the framework 14 to create workstations with visual privacy and utility access, and can be rearranged by the user to accommodate different work requirements.

The illustrated framework 14 (FIG. 1) can be arranged and constructed to subdivide a wide variety of room dimensions and to satisfy numerous spatial orientations and subdivisional requirements. The basic framework 14 includes posts 20 and beams 22 connected at an uppermost portion of posts 20. A plurality of intermediate beams 32 extending between associated posts 20 may be placed at numerous locations between floor 12 and the upper most beams 22 connected to the top of posts 20. By utilizing intermediate beams 32, framework 14 can be adapted to support a variety of lengths and widths of panels 18, including full length panels 34, partial length upper panels 36 extending between intermediate beams 32 and beams 22, partial length lower panels 38 extending between floor 12 and intermediate beams 32, partial length intermediate panels 41 extending between intermediate beams 32, partial length freestanding panels 40 supported by intermediate beams 32, and flexible hanging panels 42 supported by beams 22.

Figure 4:
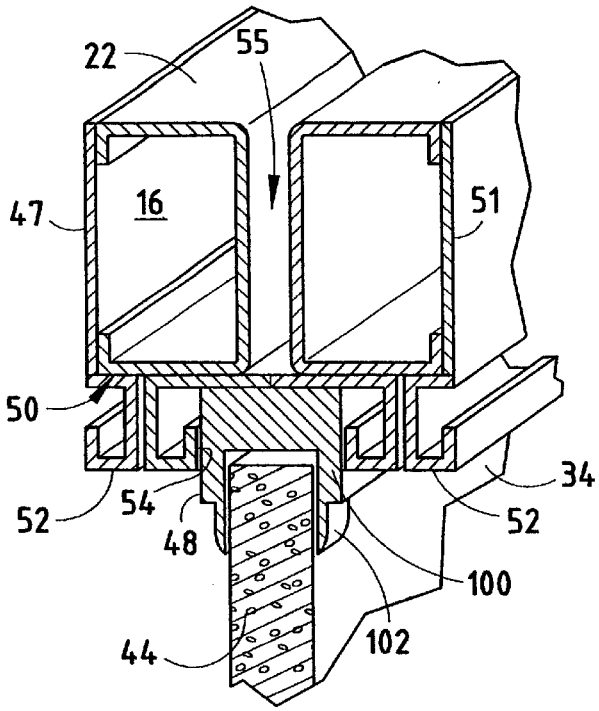
FIG. 4 is an enlarged cross-sectional perspective view of an upper beam and a thin panel.

Each beam 22, as illustrated in FIG. 4, includes a pair of C-shaped, outwardly opening upper channels 47 that house utility conduits 16, have lower surfaces 50, and define a center channel 55 therebetween. Each beam 22, further includes a pair of C-shaped hanging channels 52 downwardly extending from lower surface 50, and a downwardly opening C-shaped center channel 54. Each channel 47 of beam 22 is covered with a face plate 51 that is attached thereto by way of fasteners (not shown) such as screws, or the like. Intermediate beams 32 are constructed and configured similar to beam 22, therefore, like components are referenced by like numerals.

The illustrated utility conduits 16 (FIGS. 2, 4, and 9) extend along posts 20, beams 22, and intermediate beams 22, and provide access to utilities throughout the framework 14. The utilities can include power lines for supporting electronic equipment as well as telephone lines, telecommunication lines, and computer network wiring, thereby allowing hidden, yet easy accessible routing throughout framework 14.

Figure 5:
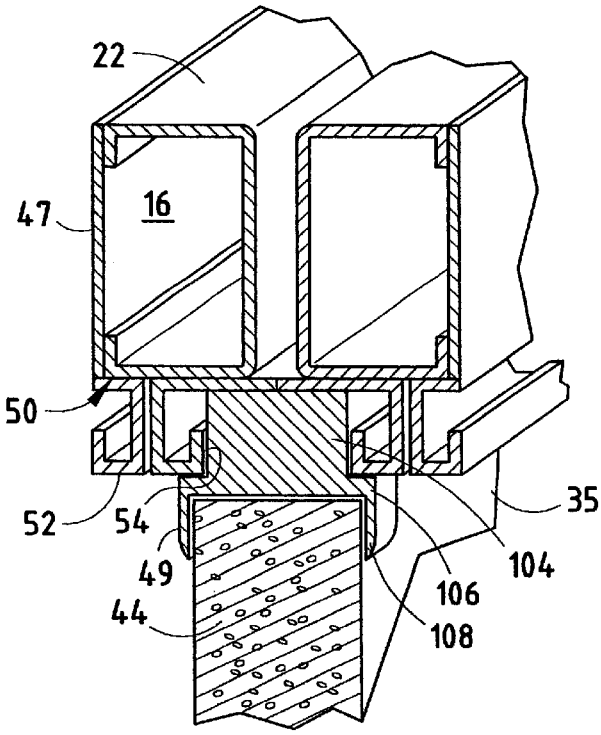
FIG. 5 is an enlarged cross-sectional perspective view of the upper beam and a thick panel.
Figure 9:
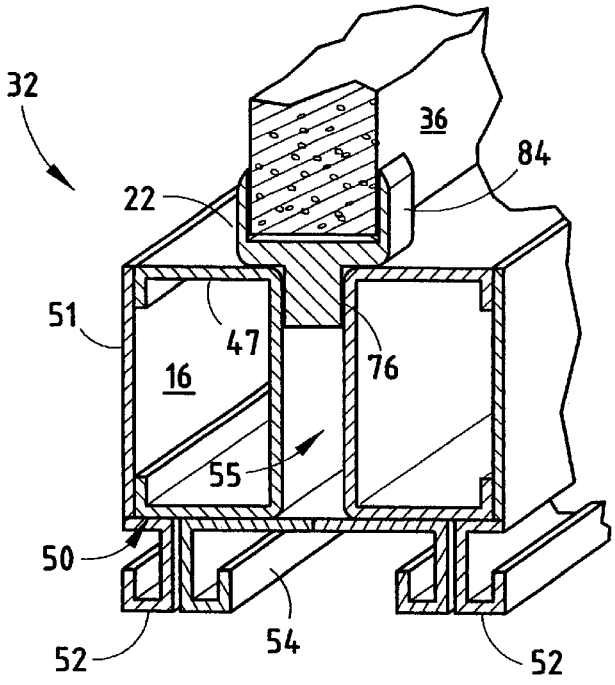
FIG. 9 is an enlarged cross-sectional perspective view of the intermediate beam and a thick center panel.

As noted above, panels 18 can be provided in a plurality of shapes and sizes, including full-length panels 34 and 35, partial length upper panels 36, partial length lower panels 38, partial length intermediate panels 41, partial length freestanding panels 40, and hanging panels 42. As best shown in FIGS. 4, 5, and 9, full-length panels 34, upper panels 36, lower panels 38, and freestanding panels 40 are constructed of a rigid material such as wood, plastic, glass, or fiber board, including fiber glass and cardboard. In addition, panels 18 can also differ in thickness as described below.

Figure 3:
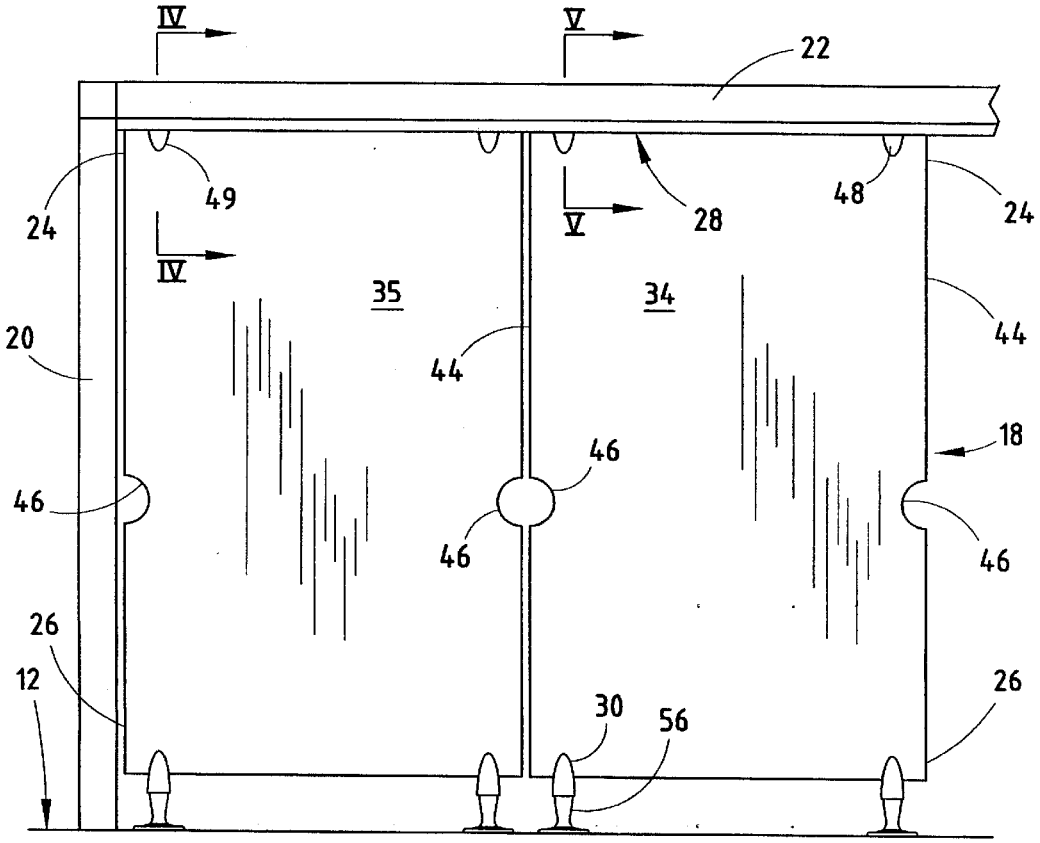
FIG. 3 is a front elevational view of a full-length panel having arcuately shaped cut outs.
Figure 3A:
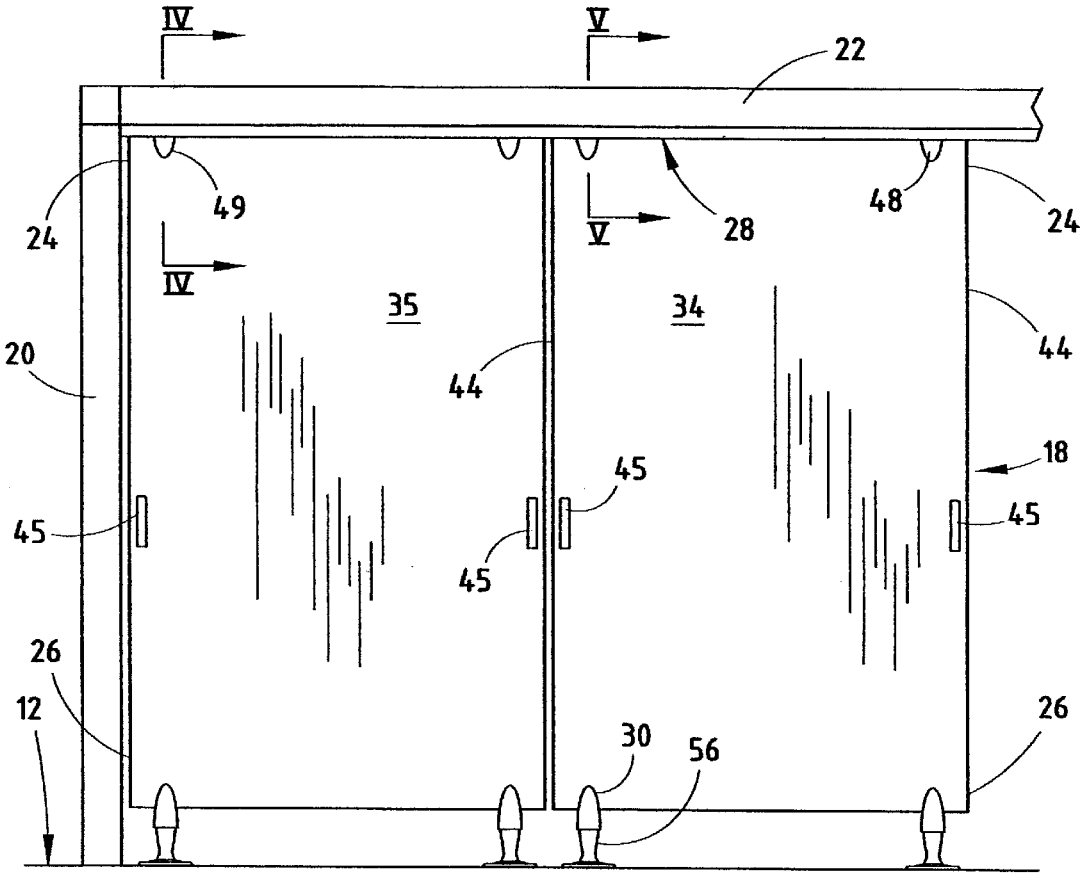
FIG. 3A is a front elevational view of a full-length panel having outwardly extending handles.

Full-length or full-height panels 34 and 35, as shown in FIG. 3, are provided a substantially rectangular shape and extend nearly the full distance between beams 22 and floor 12. Each full-length panel 34 and 35 is provided with upper panel portion 24, lower panel portion 26, and sides 44. Each full-length panel 34 and 35 is further provided with a pair of arcuate cutouts 46, juxtapositioned across full-length panel 34 and 35 and located approximately midway along sides 44. Alternatively, each full-length panel 34 and 35 (FIG. 3A) can be provided with outwardly extending handles 45 juxtapositioned across full-length panels 34 and 35 and located approximately midway along sides 44. Each panel 18 can be provided in a plurality of thicknesses depending upon the requirements of the application. In one working embodiment of the present invention, full-length panel 34 (FIG. 4) is preferably provided a thickness of approximately 1 inch, and full-length panel 35 (FIG. 5) is preferably provided a thickness of approximately 2 inches. Each full-length panel 34 and 35 is further provided with at least a pair of guide members 48 and 49, respectively, that are located along upper panel portion 24 and are adapted to fit across the width of each full-length panels 34 and 35, thereby securely retaining panels 34 and 35. Guide 48, as illustrated in FIG. 4, is used in conjunction with full-length panel 34 which is provided a more narrow thickness than full-length panel 35. More specifically, guide member 48 is provided a substantially T-shape having a horizontally oriented, upper guide portion 100 and a pair of vertically oriented, downwardly extending arms 102 that are adapted to fit across full-length panel 34 and securely hold full-length panel 34 therebetween. Guide member 48 can be constructed of hard plastic, metal or composite materials, and can be attached to full-length panel 34 by way of mechanical fasteners, adhesives, or a press fit. Guide members 49, as illustrated in FIG. 5, are used in conjunction with full-length panel 35 which is provided with a greater thickness than full-length panel 34. More specifically, each guide member 49 is provided with a substantially inverted Y-shape having an upwardly extending guide portion 104, a horizontally extending mid-section 106, and a pair of downwardly extending arms 108 that are adapted to fit across full-length panel 35. Guide members 49 are similar in construction to guide members 48 described above.

Figure 6:
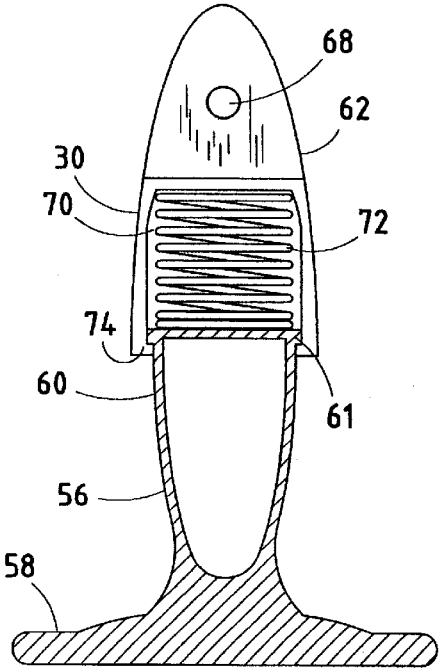
FIG. 6 is an enlarged view of a retainer and a support foot having a spring located therein.
Figure 6A:
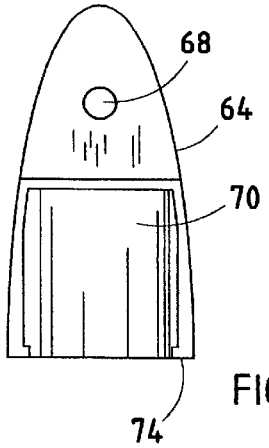
FIG. 6A is an enlarged view of a second retainer half.
Figure 6B:
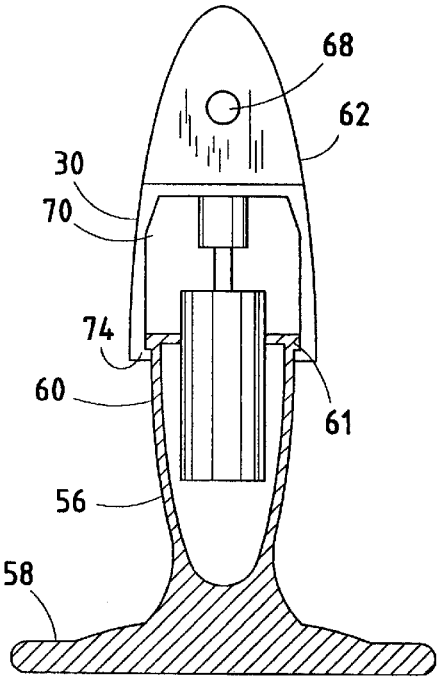
FIG. 6B is an enlarged view of an alternative retainer and a support foot having a shock absorber located therein.

The illustrated full-length panels 34 and 35 are supported by at least a pair of feet 56 (FIG. 6A) and corresponding retainers 30. Each supporting foot 56 includes a foot member 56 having a lower portion 58 adapted to stabily engage floor 12 and an upper portion 60 having an outwardly extending retaining lip 61 and adapted to be telescopingly received within retainer 30. Retainer 30 includes a first mating half 62 and a second mating half 64. Each mating half 62 and 64 is provided with a centrally located aperture 68 extending therethrough and a housing portion 70. Housing portion 70 is configured to house a spring 72 therein and is provided an inwardly extending retaining lip 74. Alternatively, retainers 30 can be provided with a gas charged shock absorber 73 in place of spring 72.

In assembly, first mating half 62 and second mating half 64 of retainer 30 are fastened together such that full-length panel 34 or 35 is clamped between first mating half 62 and second mating half 64 of retainer 30, and upper portion 60 of foot 56 is located within spring housing portion 70 of retainer 30. Retainer 30 is attached to full-length panels 34 and 35, by way of a mechanical fastener (not shown) extending through aperture 68 of first mating half 62 and second mating half 64. Alternatively, retainer 30 can be constructed such that first mating half 62 and second mating half 64 snap together across full-length panels 34 and 35, are held by an adhesive thereto, or are press fit thereabout.

Full-length panels 34 and 35 are assembled with framework 14 in similar fashion, therefore, full-length panel 34 will be illustratively described. In assembly with the framework 14 (FIG. 3), full-length panel 34 is maneuvered into place by grasping full-length panel 34 within arcuate cutouts 46. A downward-compressive force is exerted on full-length panel 34 thereby compressing spring 72 (or shock absorber 73) by forcing each foot 56 to telescope within each retainer 30. The compression of each retainer 30 shortens the effective overall length of each full-length panel 34, thereby allowing the operator to position upper panel portion 24 below lower surface 28 and guide portion 100 of guide member 48 within center channel 54 of beam 22. The operator then releases the downward pressure on full-length panel 34, thereby allowing springs 72 or each retainer 30 to force full-length panel 34 upward until upper panel portion 24 of full-length panel 34 is located within center channel 54 of beam 22. Full-length panel 34 can be removed from within framework 14 by completing the above-described steps in the opposite order, thereby creating an easily adjustable and reconfigurable partitioning system.

Alternatively, retainer 30 can be associated with clamping members 48 located along the upper panel portion 24 of each full length panel 34. Assembly of this alternative embodiment could be conducted by first inserting upper panel portion 24 of each full-length panel 34 within center channel 54 of beam 22, thereby compressing the associated retainer therein, positioning lower panel portion 26 such that full-length panel 34 is substantially vertically oriented, and then releasing the upward force being exerted on full-length panel 34.

Figure 7:
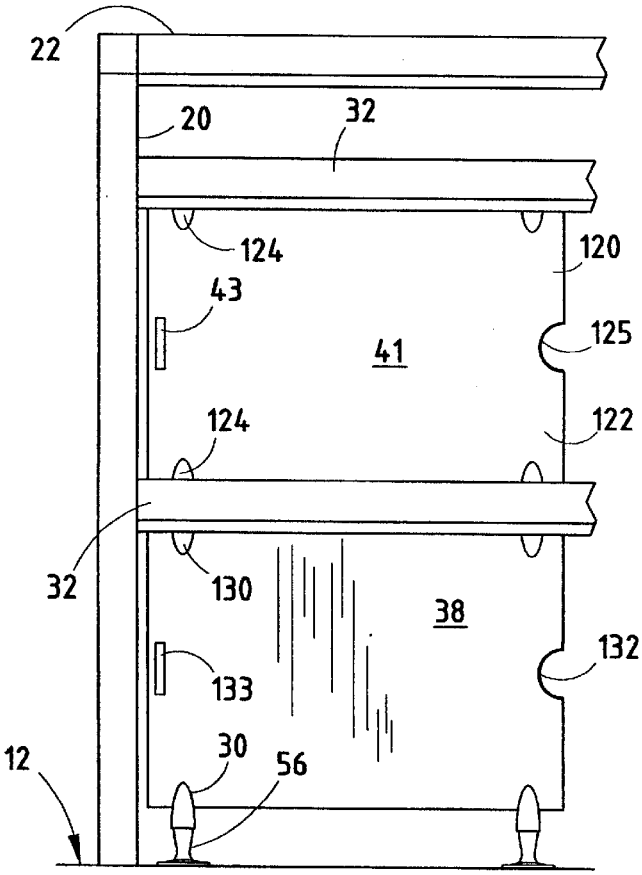
FIG. 7 is a front elevational view of a partial length lower panel extending between an intermediate beam and the floor, and a partial length intermediate panel extending between intermediate beams.

As illustrated in FIG. 7, partial length lower panels 38 extend between floor 12 and intermediate beams 32. Lower panels 38 are constructed nearly identically to full-length panels 34 and 35 described above. Lower panels 38 are provided in lengths that correspond to the distance between intermediate beams 32 and floor 12, and are further provided with upper guide members 130, arcuate cutouts 132 or handles 133, retainers 30 and supporting feet 56. In assembly, lower panels 38 are maneuvered into position within framework 14 similar to the full-length panels 34 as described above, thereby providing partial privacy between work areas, while allowing an upper breeze way therebetween.

Figure 8:
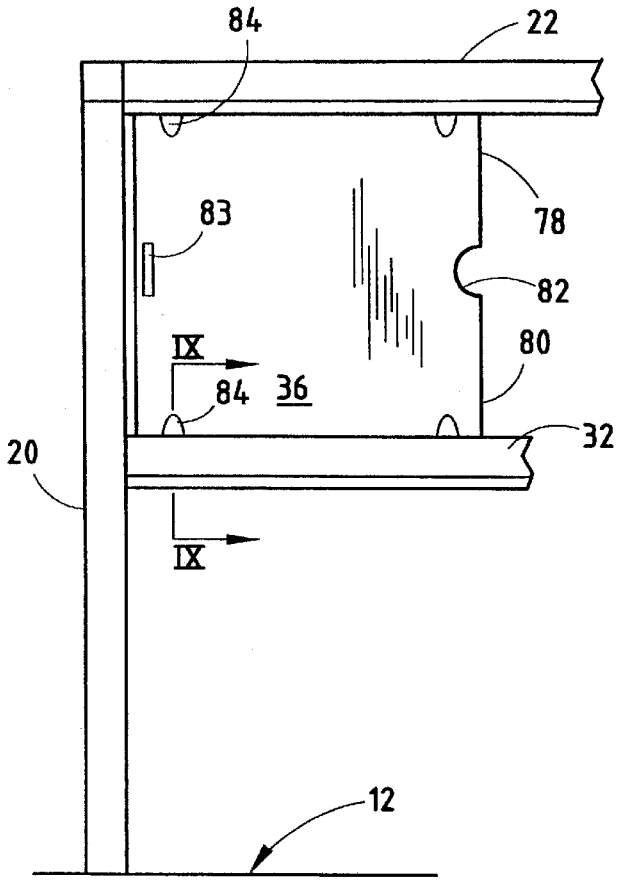
FIG. 8 is a front elevational view of a partial length upper panel extending between an intermediate beam and an upper beam.

Partial length upper panels 36 (FIG. 8) are located between intermediate beams 32 and beams 22. Each upper panel 36 is provided with an upper panel portion 78, a lower portion panel 80, arcuate cutouts 82 or handles 83, and guide members 84, similar and corresponding to upper panel portion 24, lower portion panel 26, arcuate cutouts 46, and guide member 48 of full-length panel 34, respectively. Upper partial length panels 36 (FIG. 9) can be assembled within framework 14 by locating guide member 84 associated with lower panel portion 80 within channel 55 of intermediate beams 32, and by locating guide members 84 of upper panel portion 78 of each upper panel 36 within center channel 54 of beams 22. It should be noted that guide members 84 are used for illustrative purposes and that guide members similar to guide members 48 (FIG. 4) could be used depending on the width of the panel used in the application. Upper panels 36 can provide adequate privacy between work areas in situations in which the space between the intermediate beams 32 and floor 12 are sealed off by way of office equipment, such as a desk or computer stand.

Partial length intermediate panels 41 (FIG. 7) are constructed similar to upper panels 36 and are positioned within framework 14 between intermediate beams 32. Intermediate panels 41 are provided with an upper panel portion 120 and a lower panel portion 122. Upper and lower panel portions 120 and 122 are provided with guide members 124 that are similar in construction and configuration to guide members 48 or 49 depending on the width of the intermediate panel 41. In addition, intermediate panels 14 are provided with arcuate cutouts 125. Alternatively, intermediate panels 41 can be provided with outwardly extending handles 43. In assembly, intermediate panels 41 are assembled with framework 14 similar to upper panels 36 as described above and as shown in FIG. 9. More specifically, guide members 124 of upper and lower panel portions 120 and 122 are matably inserted into intermediate beams 32, thereby retaining intermediate panels 41 within framework 14 between intermediate beams 32.

Figure 10:
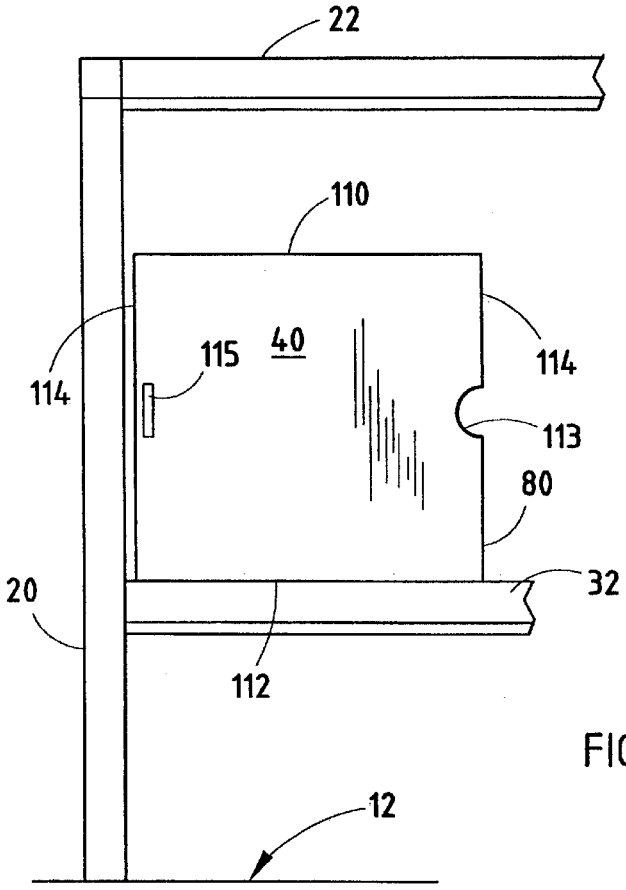
FIG. 10 is a front elevational view of a freestanding panel inserted within the intermediate beam.
Figure 11:
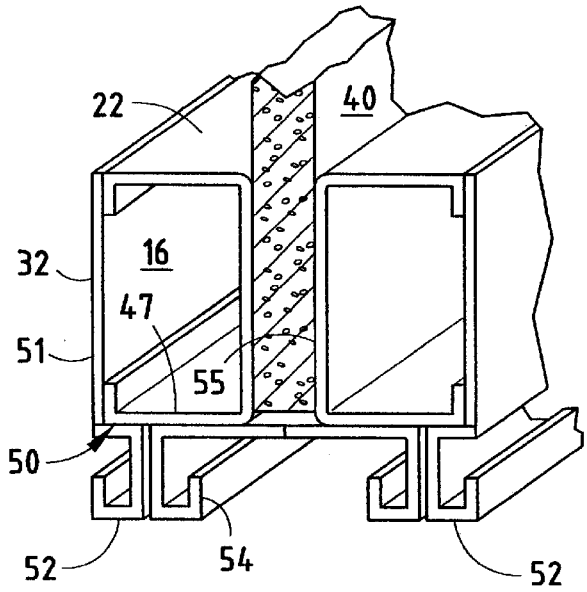
FIG. 11 is an enlarged perspective view of the freestanding panel inserted in the intermediate beam.

In the illustrated example, partial length freestanding panels 40 (FIGS. 10 and 11) are constructed of a rigid material such as fiberboard, wood, plastic, or glass. Freestanding panels 40 are provided a substantially square or rectangular shape, a top edge 110, a bottom edge 112, and side edges 114. Side edges 114 are provided arcuate cutouts 113. Alternatively, freestanding panels 40 can be provided with outwardly extending handles 115, or no grasping device/cutout at all. Each freestanding panel 40 is assembled with framework 14 by inserting bottom edge 112 of each freestanding panel 40 within channel 55 of intermediate beam 32. Freestanding panels 40 are inserted sufficiently into channel 76 of intermediate beams 32 such that additional support of freestanding panels 40 are unnecessary.

Figure 12:
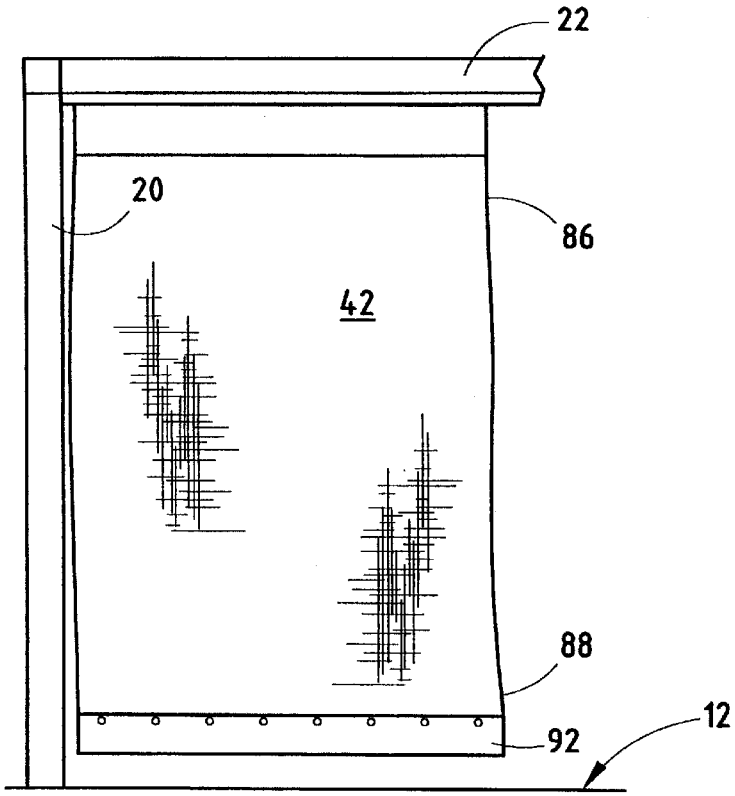
FIG. 12 is a front elevational view of a hanging/weighted screen.
Figure 13:
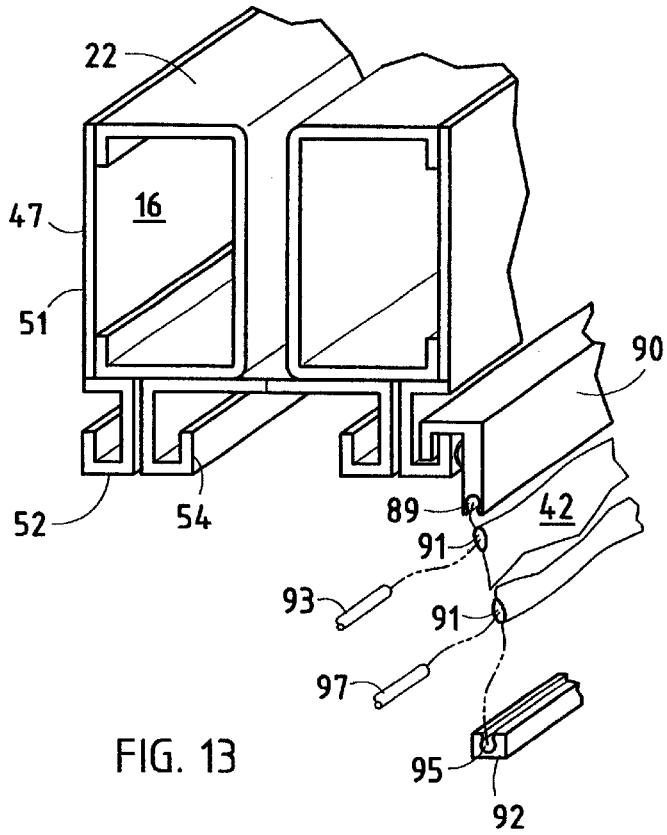
FIG. 13 is an enlarged perspective view of the upper beam and the hanging/weighted screen.

The illustrated hanging panels 42 (FIG. 12) are constructed of flexible or semi-flexible material or film, and can be provided in any length, thereby providing either partial or full visual privacy between work areas. Depending on the length, hanging panels 42 are provided with a square or substantially rectangular shape. Hanging panels 42 are further provided with an upper panel portion 86 and a lower panel portion 88 that are each provided with a laterally extending loop 91. A substantially C-shaped hanger 90 (FIG. 13) adapted to engage hanging channel 52 of beam 22 is attached along upper panel portion 86 of hanging panel 42. Hanger 90 is provided with a downwardly opening U-shaped channel 89. A rod 93 is extended through loop 91 of upper panel portion 86 and then snap fit into channel 89 of hanger 90, thereby retaining panel 42 within hanger 90. A weight 92 is attached to hanging panel 42 along lower panel portion 88. Weight 92 is provided an upwardly opening U-shaped channel 95. A rod 97 is extended through loop 91 of lower panel portion 88 and then snap fit into channel 95 of weight 92, thereby connecting weight 92 with hanging panel 42 and ensuring that hanging panel 42 hangs substantially vertical from beam 22. Inwardly facing spring clips 99 are placed within hangers 90 to ensure sufficient engagement between hangers 90 and channels 52 of beam 22. Hanging panels 42 can be easily relocated throughout framework 14 by simply lifting hanger 90 from engagement within hanging channels 52 of beam 22.

Alternatively, hanging channels 52 may be used to support rigid and semi-rigid panels, as well as numerous functional articles including marker boards, chalk boards, viewing screens, and numerous other articles such as those disclosed in U.S. Pat. No. 5,511,348.

The present inventive furniture system 10 is easily rearrangable without requiring extensive knowledge of the construction of the furniture system 10. In addition, rearrangement and reconfiguration of furniture system 10 can be done quickly, thereby lending itself to use in environments having rapidly changing requirements.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A prefabricated furniture system for interior building space of the type having a floor with an open plan, comprising:

a framework extending over the floor of the building space, and including a plurality of posts, and a plurality of beams, at least some of which are supported at a predetermined elevation above the floor to define an open, three-dimensional gridwork which spatially partitions the associated portion of the building space;

utility conduits extending along said posts and said beams to provide access to utilities throughout said gridwork; and a plurality of rigid infill panels, each being constructed to permit easy, manual, bodily translation of the same by an adult user, and shaped for positioning between said beams and the floor of the building in side-by-side juxtaposition; each of said infill panels having upper and lower panel portions equipped to removably retain the same in a selected position within said gridwork, wherein said upper panel portion is adapted to engage a lower surface of an adjacent one of said beams, said lower panel portion is adapted to engage the floor, and at least one of said upper and lower panel portions includes a resiliently extensible retainer which biases outwardly to create tight engagement between said infill panels and the floor and associated beams for securely, yet removably, retaining the same in place, whereby said infill panels can be quickly and easily installed by the user at various locations throughout said gridwork to create workstations with visual privacy and utility access, and can be rearranged by the user to accommodate different work requirements.

2. A prefabricated furniture system as set forth in claim 1, wherein:

said beams include a downwardly opening channel extending along said lower surface thereof shaped to receive and retain therein said upper panel portion of said infill panels.

3. A prefabricated furniture system as set forth in claim 2, wherein:

said infill panels include friction feet at the lower portion thereof constructed to abuttingly engage the floor, and frictionally retain said infill panels in place.

4. A prefabricated furniture system as set forth in claim 3, wherein:

said resiliently extensible retainer is disposed on the lower panel portion of said infill panels, and biases said friction feet into abutting engagement with the floor.

5. A prefabricated furniture system as set forth in claim 4, wherein:

said infill panels include handle portions to facilitate grasping the same for manipulation by the user.

6. A prefabricated furniture system as set forth in claim 5, wherein:

said infill panels include cutouts at opposite side edges thereof defining said handle portions.

7. A prefabricated furniture system as set forth in claim 6, wherein:

said cutouts are arcuate, and laterally aligned, such that when the side edges of adjacent infill panels are disposed adjacent one another, an aperture is formed between said adjacent infill panels.

8. A prefabricated furniture system as set forth in claim 7, wherein:

said infill panels include at least one guide members upstanding from said upper panel portion shaped for close reception in said channel.

9. A prefabricated furniture system as set forth in claim 8, wherein:

at least one of said beams is disposed at a first height above the floor and defines a top beam;

at least one of said beams is disposed between the floor and said to beam and defines an intermediate beam; and at least one of said infill panels is shaped to fit between the floor and said intermediate beam.

10. A prefabricated furniture system as set forth in claim 9, including:

a plurality of said intermediate beams disposed in a generally horizontal orientation at various heights; and at least one of said infill panels is shaped to fit between two vertically adjacent intermediate beams.

11. A prefabricated furniture system as set forth in claim 1, wherein:

said infill panels include friction feet at the lower portion thereof constructed to abuttingly engage the floor, and frictionally retain said infill panels in place.

12. A prefabricated furniture system as set forth in claim 1, wherein:

said resiliently extensible retainer is disposed on the lower panel portion of said infill panels.

13. A prefabricated furniture system as set forth in claim 1, wherein:

said infill panels include handle portions to facilitate grasping the same for manipulation by the user.

14. A prefabricated furniture system as set forth in claim 1, wherein:

said infill panels include cutouts at opposite side edges thereof.

15. A prefabricated furniture system as set forth in claim 14, wherein:

said cutouts are arcuate, and laterally aligned, such that when the side edges of adjacent infill panels are disposed adjacent one another, an aperture is formed between said adjacent infill panels.

16. A prefabricated furniture system as set forth in claim 1, wherein:

said infill panels include anchor posts upstanding from said upper panel portion shaped to engage the lower surface of an adjacent one of said beams.

17. A prefabricated furniture system as set forth in claim 1, wherein:

at least one of said beams is disposed at a first height above the floor and defines a top beam;

at least one of said beams is disposed between the floor and said top beam and defines an intermediate beam; and at least one of said infill panels is shaped to fit between the floor and said intermediate beam.

18. A prefabricated furniture system as set forth in claim 17, including:

a plurality of said intermediate beams disposed in a generally horizontal orientation at various heights; and at least one of said infill panels is shaped to fit between two vertically adjacent intermediate beams.

19. A prefabricated furniture system as set forth in claim 18, wherein:

each of said infill panels includes cutouts at opposite side edges thereof defining handle portions.

20. A prefabricated furniture system for interior building space of the type having a floor with an open plan, comprising:

a framework extending over the floor of the building space, and including a plurality of posts, and a plurality of beams supported at a predetermined elevation to define an open, three-dimensional gridwork which spatially partitions the associated portion of the building space;

utility conduits extending along said posts and said beams to provide access to utilities throughout said gridwork; and a plurality of rigid infill panels, each being constructed to permit easy, manual, bodily translation of the same by an adult user, and shaped for positioning between said beams; each of said infill panels having upper and lower panel portions equipped to removably retain the same in a selected position within said gridwork, wherein said upper panel portion is adapted to engage a lower surface of an adjacent one of said beams, said lower panel portion is adapted to engage an upper surface of an adjacent one of said beams, and at least one of said upper and lower panel portions includes a resiliently extensible retainer which biases outwardly to create tight engagement between said infill panels and the associated beams for securely, yet removably, retaining the same in place, whereby said infill panels can be quickly and easily installed by the user at various locations throughout said gridwork to create workstations with visual privacy and utility access, and can be rearranged by the user to accommodate different work requirements.

21. A prefabricated furniture system as set forth in claim 20, wherein:

at least one of said beams is disposed at a first height above the floor and defines a top beam;

at least one of said beams is disposed between the floor and said top beam and defines an intermediate beam; and at least one of said infill panels is shaped to fit between the floor and said intermediate beam.

22. A prefabricated furniture system as set forth in claim 21, including:

a plurality of said intermediate beams disposed in a generally horizontal orientation at various heights; and at least one of said infill panels is shaped to fit between two vertically adjacent intermediate beams.

23. A prefabricated furniture system as set forth in claim 22, wherein:

said intermediate beams include a downwardly opening channel extending along the lower surface thereof and an upwardly opening channel extending along an upper surface thereof; said upper and lower channels being similarly shaped, and adapted to receive therein a portion of one of said infill panels.

24. A prefabricated furniture system as set forth in claim 21, wherein:

said top beam includes at least one hanger channel; and including at least one hanging panel detachably supported by said hanger channel.

25. A method for partitioning interior building space of the type having a floor with an open plan, comprising:

erecting a framework over the floor of the building space, by assembling a plurality of posts, and a plurality of beams, at least some of which are supported at a predetermined elevation above the floor to define an open, three-dimensional gridwork which spatially partitions the associated portion of the building space;

providing utility conduits along the posts and the beams to provide access to utilities throughout the gridwork; and providing a plurality of rigid infill panels, each being constructed to permit easy, manual, bodily translation of the same by an adult user, and shaped for positioning between the beams and the floor of the building; each of the infill panels having upper and lower panel portions equipped to removably retain the same in a selected position within the gridwork, wherein the upper panel portion is adapted to engage a lower surface of an adjacent one of the beams, the lower panel portion is adapted to engage the floor, and at least one of the upper and lower panel portions includes a resiliently extensible retainer which biases outwardly to create tight engagement between the infill panels and the floor and associated beams;

manually installing the infill panels between the floor and the beams in side-by-side juxtaposition by selectively compressing the retainer and then releasing the same once the infill panel is in place under the beam, thereby securely, yet removably, retaining the same in place, whereby the infill panels are quickly and easily installed by the user at various locations throughout the gridwork to create workstations with visual privacy and utility access, and can be rearranged by the user to accommodate different work requirements.

26. The method described in claim 25, wherein:

said step of manually installing the infill panels includes compressing the retainer against the floor.

27. The method described in claim 26, wherein:

said step of manually installing the infill panels includes compressing the retainer against the beam.

* * * * *

UNITED STATES PATENT AND TRADEMARK OFFICE

CERTIFICATE OF CORRECTION

PATENT NO. : 6,279,643 B1
DATED : August 28, 2001
INVENTOR(S) : David A. Shipman It is certified that error appears in the above-identified patent and that said Letters Patent is hereby corrected as shown below:

Title page,
ABSTRACT, line 16, "positioned" should be -- position --.

Column 3,
Line 39, "cut outs" should be -- cutouts --.

Column 6,
Line 14, "stabily" should be -- stably --.

Column 7,
Line 17, "portion panel" should be -- panel portion --.

Column 9,
Line 43, "members" should be -- member --.
Line 52, "to" should be -- top --.

Signed and Sealed this

Ninth Day of July, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,279,643 B1
DATED : August 28, 2001
INVENTOR(S) : David A. Shipman It is certified that error appears in the above-identified patent and that said Letters Patent is hereby corrected as shown below:

Title page,
Item [73], Assignee, "Steelcase Inc." should be -- Steelcase Development Inc. --.

Signed and Sealed this

Tenth Day of September, 2002

*Attest:*

*Attesting Officer*

JAMES E. ROGAN
*Director of the United States Patent and Trademark Office*